United States Patent [19]

Hilmers

[11] Patent Number: 4,823,327

[45] Date of Patent: Apr. 18, 1989

[54] ELECTROACOUSTIC TRANSDUCER

[75] Inventor: Horst Hilmers, Kronshagen, Fed. Rep. of Germany

[73] Assignee: Honeywell-Elac-Nautik GmbH, Fed. Rep. of Germany

[21] Appl. No.: 57,062

[22] Filed: Jun. 1, 1987

[30] Foreign Application Priority Data

Jun. 14, 1986 [DE] Fed. Rep. of Germany ..... 3620085

[51] Int. Cl.[4] ..... H04R 17/00

[52] U.S. Cl. ..... 367/157; 367/155; 367/165; 310/337

[58] Field of Search ..... 310/322, 334, 337, 369; 367/155, 158, 163, 165, 157, 159, 164; 181/400, 401, 402

[56] References Cited

U.S. PATENT DOCUMENTS

| | | | |
|---|---|---|---|
| 3,142,035 | 7/1964 | Harris | 310/337 X |
| 4,072,871 | 2/1978 | Wilson | 367/158 X |
| 4,305,140 | 12/1981 | Massu | 367/155 X |
| 4,433,399 | 2/1984 | Massu | 310/337 X |
| 4,604,542 | 8/1986 | Thompson | 310/337 X |

*Primary Examiner*—Brian S. Steinberger

*Attorney, Agent, or Firm*—Charles L. Rubow

[57] ABSTRACT

For increasing the bandwidth of an electroacoustic omnidirectional transducer a piezoceramic tube is provided at its outer circumference with segment-shaped additional mass members having a larger outer surface area than the piezoceramic tube.

12 Claims, 1 Drawing Sheet

ELECTROACOUSTIC TRANSDUCER

BACKGROUND OF THE INVENTION

The invention relates to electroacoustic transducers primarily for use in underwater communication or reconnaissance systems. Transducers having an omnidirectional radiation diagram are known consisting of a tube made of a piezoceramic material provided with electrodes on its outer wall surface and on its internal wall surface for applying electrical energizing voltages to said electrodes and therewith generating oscillations of the wall surfaces of said tube so that acoustic waves are emitted around the axis of the transducer tube. The same type of transducer can be used as a non-directional receiver. These transducers are used in a resonant mode which means that they are selective for a particular limited frequency range. Furthermore, directional transducers are known emitting sound waves or ultrasound waves into a particular direction and consisting of an array of disc-shaped transducer elements. In connection with this type of directional transducers it is known to provide at one side of the disc-shaped transducer element an additional mass member of conical shape for increasing the radiating surface of the transducer and simultaneously to provide at the opposite surface of the disc a counter mass member. These electroacoustic transducers as mentioned above emit radiation into a particular direction, and the increase of the radiating surface by means of the additional mass members is just for the purpose of focussing the radiated sound waves into a particular direction.

SUMMARY OF THE INVENTION

It is the main object of the present invention to describe an omnidirectional electroacoustic transducer having a tube of piezoceramic material, which transducer is not tuned to a particular frequency but has broadband behavior without increasing its volume and weight and is useful for receiving or radiating sound waves at low frequencies in the range of 5 to 15 kHz.

This and other objects are achieved by the invention disclosing a transducer which comprises a tube of piezoceramic material which is provided with electrodes on its outer wall surface and on its internal wall surface with the invention providing that the transducer comprises metallic additional mass members fixed to said electrodes at the outer wall surface, said mass members having a cross section shaped like a ring-segment and all mass members together having an outer surface area which is larger than the outer surface area of said piezoceramic tube. By these means a transducer is disclosed having an omnidirectional radiation pattern in radial direction and whose acoustically effective surface is increased with respect to the outer surface area of the piezoelectric tube and simultaneously the resonant frequency of the tube-like transducer is decreased. The aforementioned resonant frequency is the frequency of the energizing AC voltage fed to the electrodes at which the entire tube shows the maximum expansion oscillations of its outer circumference. It has to be distinguished from the so-called wall thickness resonant frequency of the tube which is the energizing frequency at which the thickness of the tube wall shows its maximum amplitude oscillations. This wall thickness resonant frequency is essentially lower than the so-called pumping frequency of the outer diameter of the tube. The invention provides a transducer which is less frequency-selective than a transducer consisting only of a piezoceramic tube, i.e. it covers a broader frequency range in the transmitting mode as well as in the receiving mode.

Preferred embodiments of the invention are described in the subclaims.

DESCRIPTION OF THE PREFERRED EMBODIMENT

Figure 1:
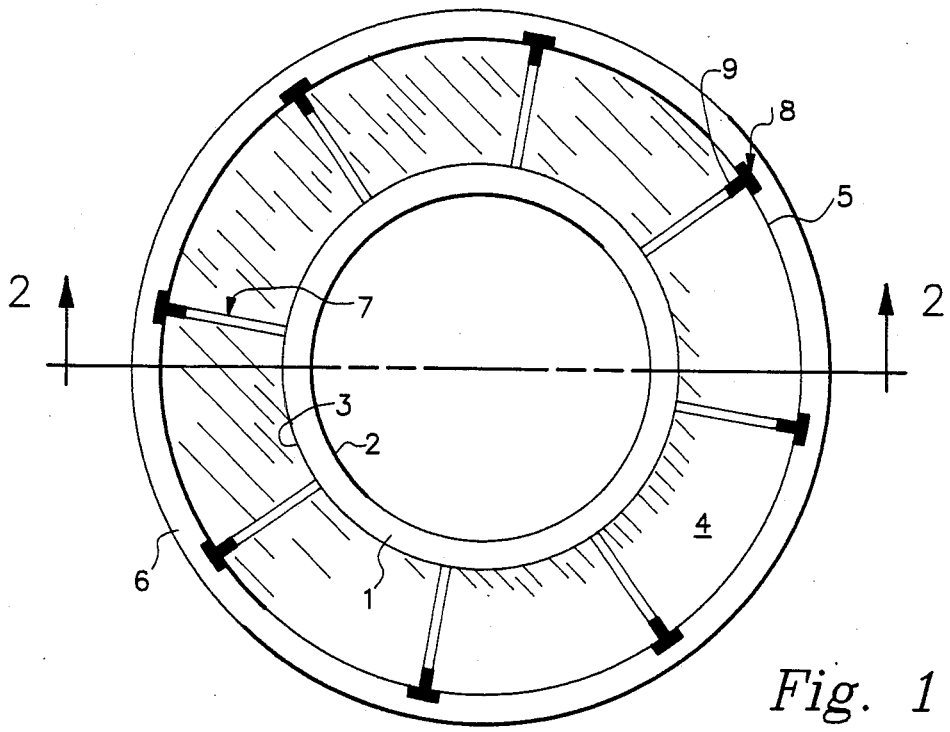
FIG. 1 shows the configuration of the transducer seen in axial direction of the piezoceramic tube and FIG. 2 shows a cross section along the axis of the tube.
Figure 2:
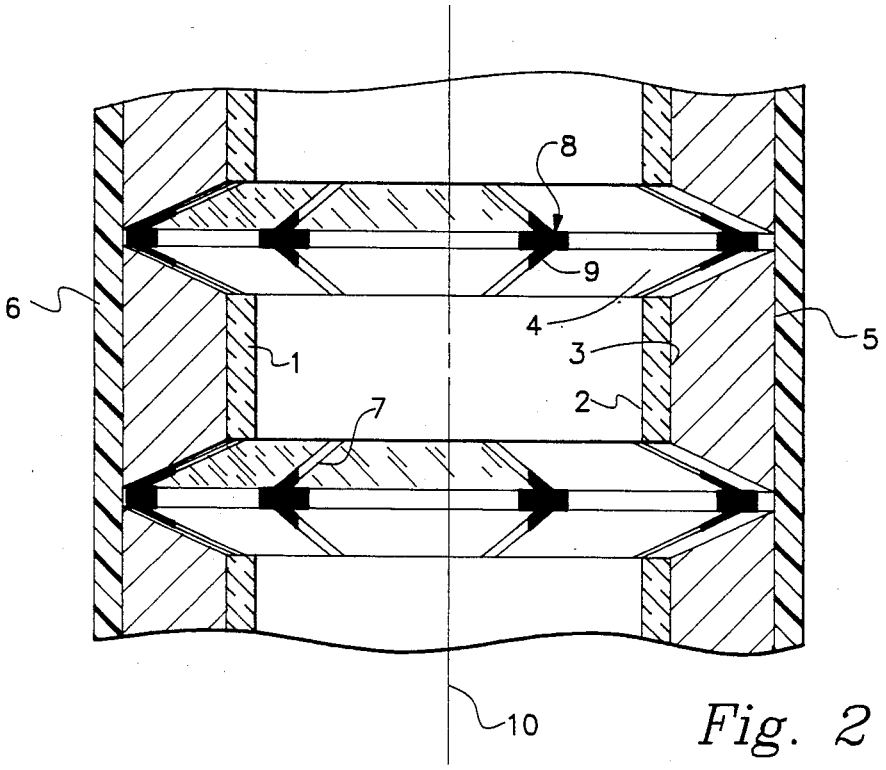

The transducer comprises a piezoceramic tube 1 having electrodes 2 on its internal wall surface and having metal electrodes 3 on its outside wall surface. Electrical terminals of these electrodes are connected in a well-known manner to an external circuitry which either provides the energizing voltage for the piezoceramic transducer body if used in the transmitting mode, or this circuit receives the voltages generated at the electrodes by the mechanical deformation of the piezoceramic body caused by received acoustic waves if used in the receiving mode. In the transmitting mode an AC voltage is fed to electrodes 2 and 3, and these voltages energize the tube 1 to exercise radial oscillations of its outer wall surface. On the outer wall surface of tube 1 additional mass members 4 are bonded to the electrodes with said mass members 4 having an outside surface area 5 which is larger than the surface area of the mass members on the side which is fixed to the electrodes 3 on tube 1. By these additional mass members the effective radiation surface of the transducer is increased. The additional mass members 4 might be made of an aluminum alloy. The outer wall surface area 5 of the additional mass members is not only larger in circumferential direction, but in addition this outer surface also projects an axial direction beyond the length of the ceramic tube 1, as this is shown in FIG. 2. Herewith a further increase of the effective radiating surface is achieved. The individual additional mass members 4 on their outer circumference are surrounded by a tube-like shell 6 of plastic material, casting compound or rubber which can be vulcanized onto the outer surfaces 5 of the mass members. Profile bars 8 of T-shaped cross section are closing the outer end surface of the gaps 7 between adjacent mass members 4 so that during casting the shell material onto the outer surfaces 5 of the mass members no casting material can enter into the gaps 7. The central leg 9 of each bar 8 projects into the associated gap 7.

FIG. 2 shows a single transducer tube 1 within shell 6. However, the broken lines at the end of tube 6 indicate that several transducers of the type shown in FIG. 2 might be arranged side by side along the common axis 10 within this tube-like shell 6. The use of several transducers instead of a single transducer improves the concentration of the emitted sound waves into a particular disc-shaped areas surrounding the transducer. The electrical connecting wires for electrodes 2 and 3 can be guided through the internal hollow space of tube 1.

I claim:

1. An electroacoustic transducer comprising:

a unitary piezoceramic tube extending along a central longitudinal axis, said tube having outer and inner wall surfaces, each having an electrode thereon;

metallic mass members fixed directly to the electrode on the outer wall surface of said piezoceramic tube and circumferentially spaced apart with a gap between adjacent members, said mass members being arranged to form a segmented annulus about said tube, each of said mass members having an outer surface at a larger distance from the central axis than the outer surface of said piezoceramic tube and having a greater length parallel with the axis than said piezoceramic tube; and profile bars of T-shaped cross section each having a central leg and a cross member are provided for closing the gaps between adjacent mass members at the outer surfaces thereof, with the central legs of the T-shaped profiles projecting into said gaps.

2. The transducer of claim 1 having the metallic mass members made of an aluminum alloy.

3. The transducer of claim 2 including a plastic shell surrounding at least the outer surfaces of said mass members.

4. The transducer of claim 2 including a shell made of a casting compound surrounding at least the outer surfaces of said mass members.

5. The transducer of claim 2 comprising a rubber shell surrounding at least the outer surface areas of said mass members.

6. The transducer of claim 1 including a plastic shell surrounding at least the outer surfaces of said mass members.

7. The transducer of claim 1 including a shell made of a casting compound surrounding at least the outer surfaces of said mass members.

8. The transducer of claim 1 including a rubber shell surrounding at least the outer surface areas of said mass members.

9. Electroacoustic transducer apparatus comprising a plurality of transducers arranged along a common central longitudinal axis within said shell wherein each transducer comprises:

a unitary piezoceramic tube extending along a central longitudinal axis, said tube having outer and inner wall surfaces, each having an electrode thereon; metallic mass members fixed directly to the electrode on the outer wall surface of said piezoceramic tube and circumferentially spaced apart with a gap between adjacent members, said mass members being arranged to form a segmented annulus about said tube, each of said mass members having an outer surface at a larger distance from the central axis than the outer surface of said piezoceramic tube and having a greater length parallel with the axis than said piezoceramic tube; and profile bars of T-shaped cross section each having a central leg and a cross member are provided for closing the gaps between adjacent mass members at the outer surfaces thereof, with the central legs of the T-shaped profiles projecting into said gaps.

10. The transducer of claim 9 including a plastic shell surrounding at least the outer surfaces of said mass members.

11. The transducer of claim 9 including a shell made of a casting compound surrounding at least the outer surfaces of said mass members.

12. The transducer of claim 9 comprising a rubber shell surrounding at least the outer surface areas of said mass members.

* * * * *